US008726645B2

(12) United States Patent
Shang et al.

(10) Patent No.: US 8,726,645 B2
(45) Date of Patent: May 20, 2014

(54) HYDRAULIC CONTROL SYSTEM HAVING ENERGY RECOVERY

(75) Inventors: Tonglin Shang, Bolingbrook, IL (US); Jiao Zhang, Naperville, IL (US); Pengfel Ma, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 825 days.

(21) Appl. No.: 12/968,975

(22) Filed: Dec. 15, 2010

(65) Prior Publication Data

US 2012/0151904 A1 Jun. 21, 2012

(51) Int. Cl.
*F15B 21/14* (2006.01)

(52) U.S. Cl.
USPC ..... 60/416; 60/414

(58) Field of Classification Search
USPC ..... 60/413, 414, 416
See application file for complete search history.

(56) References Cited

U.S. PATENT DOCUMENTS

| | | | | |
|---|---|---|---|---|
| 3,477,347 | A | 11/1969 | Rice | |
| 4,345,436 | A | 8/1982 | Johnson | |
| 5,878,569 | A | 3/1999 | Satzler | |
| 6,151,894 | A | 11/2000 | Endo et al. | |
| 6,358,174 | B1 | 3/2002 | Folsom et al. | |
| 6,378,301 | B2 | 4/2002 | Endo et al. | |
| 6,467,264 | B1 | 10/2002 | Stephenson et al. | |
| 6,502,393 | B1 | 1/2003 | Stephenson et al. | |
| 6,615,786 | B2 | 9/2003 | Mori et al. | |
| 6,655,136 | B2 | 12/2003 | Holt et al. | |
| 6,718,759 | B1 | 4/2004 | Tabor | |
| 6,739,127 | B2 | 5/2004 | Nippert et al. | |
| 6,748,738 | B2 | 6/2004 | Smith | |
| 6,789,387 | B2 | 9/2004 | Brinkman | |
| 7,444,809 | B2 | 11/2008 | Smith et al. | |
| 7,565,801 | B2 * | 7/2009 | Tozawa et al. | 60/414 |
| 2009/0000290 | A1 * | 1/2009 | Brinkman | 60/414 |
| 2009/0217653 | A1 * | 9/2009 | Zhang et al. | 60/414 |

FOREIGN PATENT DOCUMENTS

| | | |
|---|---|---|
| EP | 1413773 | 4/2004 |
| JP | 2004324743 | 11/2004 |
| JP | 2007040393 | 2/2007 |
| JP | 2010084888 | 4/2010 |
| JP | 2010121726 | 6/2010 |

* cited by examiner

*Primary Examiner* — Thomas E Lazo
(74) *Attorney, Agent, or Firm* — Finnegan, Henderson, Farabow, Garrett & Dunner LLP

(57) ABSTRACT

A hydraulic control system for a machine is disclosed. The hydraulic control system may have a tank, a pump configured to draw fluid from the tank and pressurize the fluid, a swing motor configured to receive the pressurized fluid and swing a body of the machine relative to an undercarriage, and a tool actuator configured to receive the pressurized fluid and move a tool relative to the body. The hydraulic control system may also have an energy recovery device configured to convert hydraulic energy to mechanical energy, a first accumulator configured to store waste fluid received from the swing motor, and a second accumulator configured to store waste fluid received from the tool actuator. Stored waste fluid from at least one of the first and second accumulators may be selectively discharged into the energy recovery device.

20 Claims, 3 Drawing Sheets

HYDRAULIC CONTROL SYSTEM HAVING ENERGY RECOVERY

TECHNICAL FIELD

The present disclosure relates generally to a hydraulic control system, and more particularly, to a hydraulic control system having energy recovery.

BACKGROUND

Machines such as dozers, loaders, excavators, motor graders, and other types of heavy equipment use one or more hydraulic actuators to move a work tool. These actuators are fluidly connected to a pump on the machine that provides pressurized fluid to chambers within the actuators. As the pressurized fluid moves into or through the chambers, the pressure of the fluid acts on hydraulic surfaces of the chambers to affect movement of the actuator and the connected work tool. When the pressurized fluid is drained from the chambers, it is returned to a low pressure sump on the machine.

One problem associated with this type of hydraulic arrangement involves efficiency. In particular, the fluid draining from the actuator chambers to the sump has a pressure greater than the pressure of the fluid already within the sump. As a result, the higher pressure fluid draining into the sump still contains some energy that is wasted upon entering the low pressure sump. This wasted energy reduces the efficiency of the hydraulic system.

One method of improving the efficiency of such a hydraulic system is described in U.S. Pat. No. 7,444,809 (the '809 patent) issued to Smith et al. on Nov. 4, 2008. The '809 patent describes a hydraulic regeneration system for a work machine. The hydraulic regeneration system has a tank, a primary source, an actuator, an accumulator, and an energy recovery device. The primary source is configured to draw fluid from the tank and discharge the fluid at an elevated pressure to the actuator. During movement of the actuator, waste fluid from the actuator is directed into the accumulator for storage. This stored fluid is then directed from the accumulator through the energy recovery device to recover some of the energy from the waste fluid, thereby improving the efficiency of the hydraulic regeneration system.

Although the system of the '809 patent may have improved efficiency compared to a conventional hydraulic system, it may nonetheless be in need of improvement. Specifically, the system of the '809 patent requires complex valving to control fluid flows between the actuator, the accumulator, the energy storage device, and the primary source. This complex valving may be difficult to control and increase a cost of the system. In addition, energy from pressurized fluid used to swing a machine may not be recovered by the system of the '809 patent.

The disclosed hydraulic control system is directed to overcoming one or more of the problems set forth above and/or other problems known in the art.

SUMMARY

One aspect of the present disclosure is directed to a hydraulic control system. The hydraulic control system may include a tank, a pump configured to draw fluid from the tank and pressurize the fluid, a swing motor configured to receive the pressurized fluid and swing a body of a machine relative to an undercarriage, and a tool actuator configured to receive the pressurized fluid and move a tool relative to the body. The hydraulic control system may also have an energy recovery device configured to convert hydraulic energy to mechanical energy, a first accumulator configured to store waste fluid received from the swing motor, and a second accumulator configured to store waste fluid received from the tool actuator. Stored waste fluid from at least one of the first and second accumulators may be selectively discharged into the energy recovery device.

Another aspect of the present disclosure is directed to a method of recovering energy. The method may include pressurizing a fluid, utilizing the pressurized fluid to swing a body of a machine relative to an undercarriage, and utilizing the pressurized fluid to move a tool relative to the body. The method may further include storing first pressurized waste fluid used to swing the body, storing second pressurized waste fluid used to move the tool, and selectively converting hydraulic energy from at least one of the stored first pressurized waste fluid and the stored second pressurized waste fluid to mechanical energy used to pressurize the fluid.

DETAILED DESCRIPTION

Figure 1:
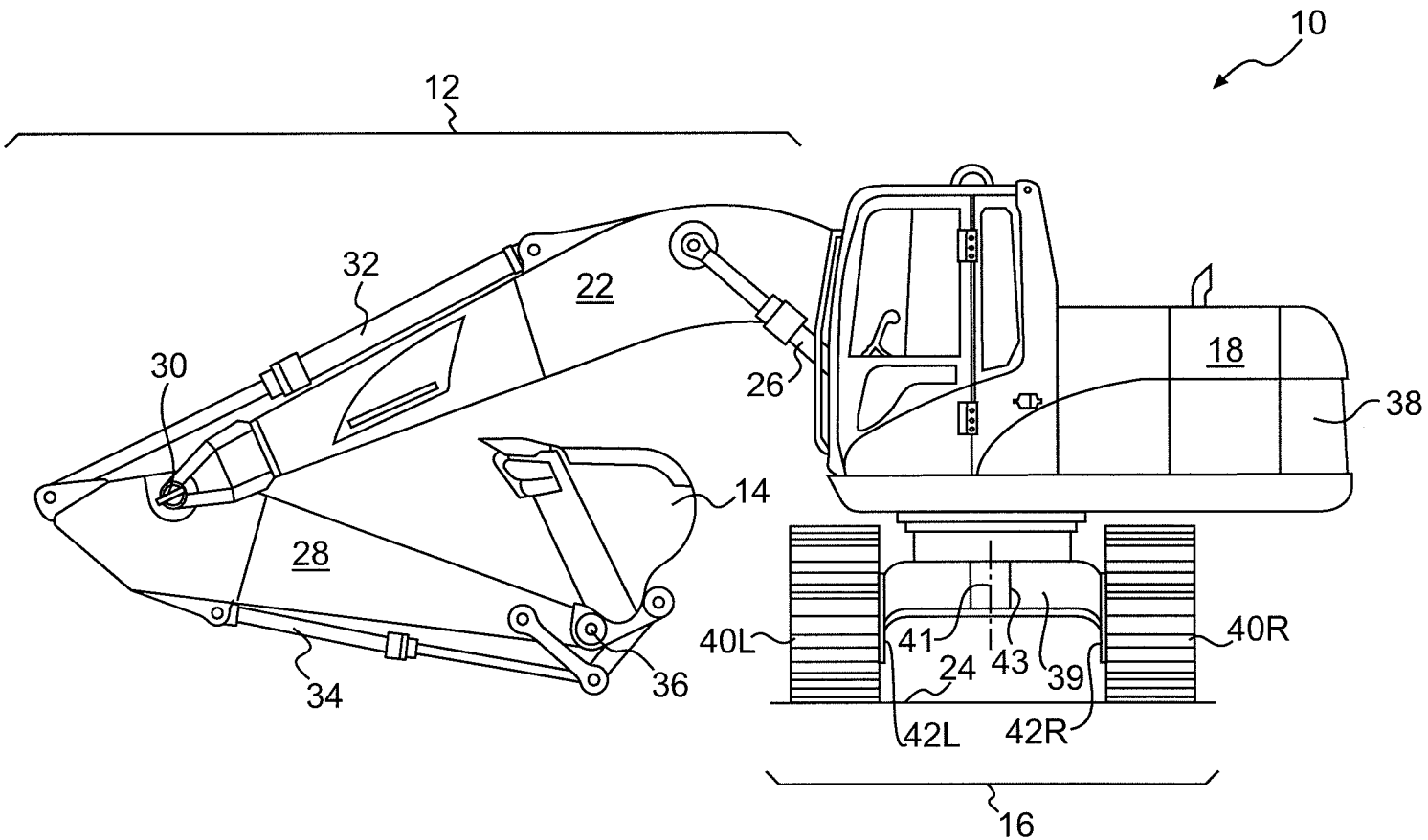
FIG. 1 is a diagrammatic illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or any other industry known in the art. For example, machine 10 may be an earth moving machine such as an excavator, a dozer, a loader, a backhoe, a motor grader, a dump truck, or any other earth moving machine. Machine 10 may include an implement system 12 configured to move a work tool 14, a drive system 16 for propelling machine 10, and a power source 18 that provides power to implement system 12 and drive system 16.

Implement system 12 may include a linkage structure acted on by fluid actuators to move work tool 14. Specifically, implement system 12 may include a boom member 22 vertically pivotal about a horizontal axis (not shown) relative to a work surface 24 by a pair of adjacent, double-acting, hydraulic cylinders 26 (only one shown in FIG. 1). Implement system 12 may also include a stick member 28 vertically pivotal about a horizontal axis 30 by a single, double-acting, hydraulic cylinder 32. Implement system 12 may further include a single, double-acting, hydraulic cylinder 34 operatively connected between stick member 28 and work tool 14 to pivot work tool 14 vertically about a horizontal pivot axis 36. Boom member 22 may be pivotally connected to a body 38 of machine 10. Body 38 may be pivoted relative to an undercarriage 39 about a vertical axis 41 by a hydraulic swing motor 43. Stick member 28 may pivotally connect boom member 22 to work tool 14 by way of axis 30 and 36.

Each of hydraulic cylinders 26, 32, and 34 may include a tube and a piston assembly (not shown) arranged to form two separated pressure chambers (e.g., a head chamber and a rod chamber). The pressure chambers may be selectively supplied with pressurized fluid and drained of the pressurized fluid to cause the piston assembly to displace within the tube, thereby changing an effective length of hydraulic cylinders 26, 32, 34. The flow rate of fluid into and out of the pressure chambers may relate to a velocity of hydraulic cylinders 26, 32, 34, while a pressure differential between the two pressure chambers may relate to a force imparted by hydraulic cylinders 26, 32, 34 on the associated linkage members. The expansion and retraction of hydraulic cylinders 26, 32, 34 may function to assist in moving work tool 14.

Numerous different work tools 14 may be attachable to a single machine 10 and operator controllable. Work tool 14 may include any device used to perform a particular task such as, for example, a bucket, a fork arrangement, a blade, a shovel, a ripper, a dump bed, a broom, a snow blower, a propelling device, a cutting device, a grasping device, or any other task-performing device known in the art. Although connected in the embodiment of FIG. 1 to pivot in the vertical direction relative to body 38 of machine 10, work tool 14 may alternatively or additionally rotate, slide, swing, lift, or move in any other manner known in the art.

Swing motor 43, like hydraulic cylinders 26, 32, 34, may be driven by a fluid pressure differential. Specifically, swing motor 43 may include first and second chambers (not shown) located to either side of an impeller (not shown). When the first chamber is filled with pressurized fluid and the second chamber is drained of fluid, the impeller may be urged to rotate in a first direction. Conversely, when the first chamber is drained of fluid and the second chamber is filled with pressurized fluid, the impeller may be urged to rotate in an opposite direction. The flow rate of fluid into and out of the first and second chambers may determine an output rotational velocity of swing motor 43, while a pressure differential across the impeller may determine an output torque.

Drive system 16 may include one or more traction devices powered to propel machine 10. In the disclosed example, drive system 16 includes a left track 40L located on one side of machine 10, and a right track 40R located on an opposing side of machine 10. Left track 40L may be driven by a left travel motor 42L, while right track 40R may be driven by a right travel motor 42R. It is contemplated that drive system 16 could alternatively include traction devices other than tracks such as wheels, belts, or other known traction devices. Machine 10 may be steered by generating a speed and or rotational direction difference between left and right travel motors 42L, 42R, while straight travel may be facilitated by generating substantially equal output speeds and rotational directions from left and right travel motors 42L, 42R.

Similar to swing motor 43, each of left and right travel motors 42L, 42R may be driven by creating a fluid pressure differential. Specifically, each of left and right travel motors 42L, 42R may include first and second chambers (not shown) located to either side of an impeller (not shown). When the first chamber is filled with pressurized fluid and the second chamber is drained of fluid, the impeller may be urged to rotate a corresponding traction device in a first direction. Conversely, when the first chamber is drained of the fluid and the second chamber is filled with the pressurized fluid, the respective impeller may be urged to rotate the traction device in an opposite direction. The flow rate of fluid into and out of the first and second chambers may determine a rotational velocity of left and right travel motors 42L, 42R, while a pressure differential between left and right travel motors 42L, 42R may determine a torque.

Power source 18 may embody an engine such as, for example, a diesel engine, a gasoline engine, a gaseous fuel-powered engine, or any other type of combustion engine known in the art. It is contemplated that power source 18 may alternatively embody a non-combustion source of power such as a fuel cell, a power storage device, or another source known in the art. Power source 18 may produce a mechanical or electrical power output that may then be converted to hydraulic power for moving hydraulic cylinders 26, 32, 34 and left travel, right travel, and swing motors 42L, 42R, 43.

Figure 2:
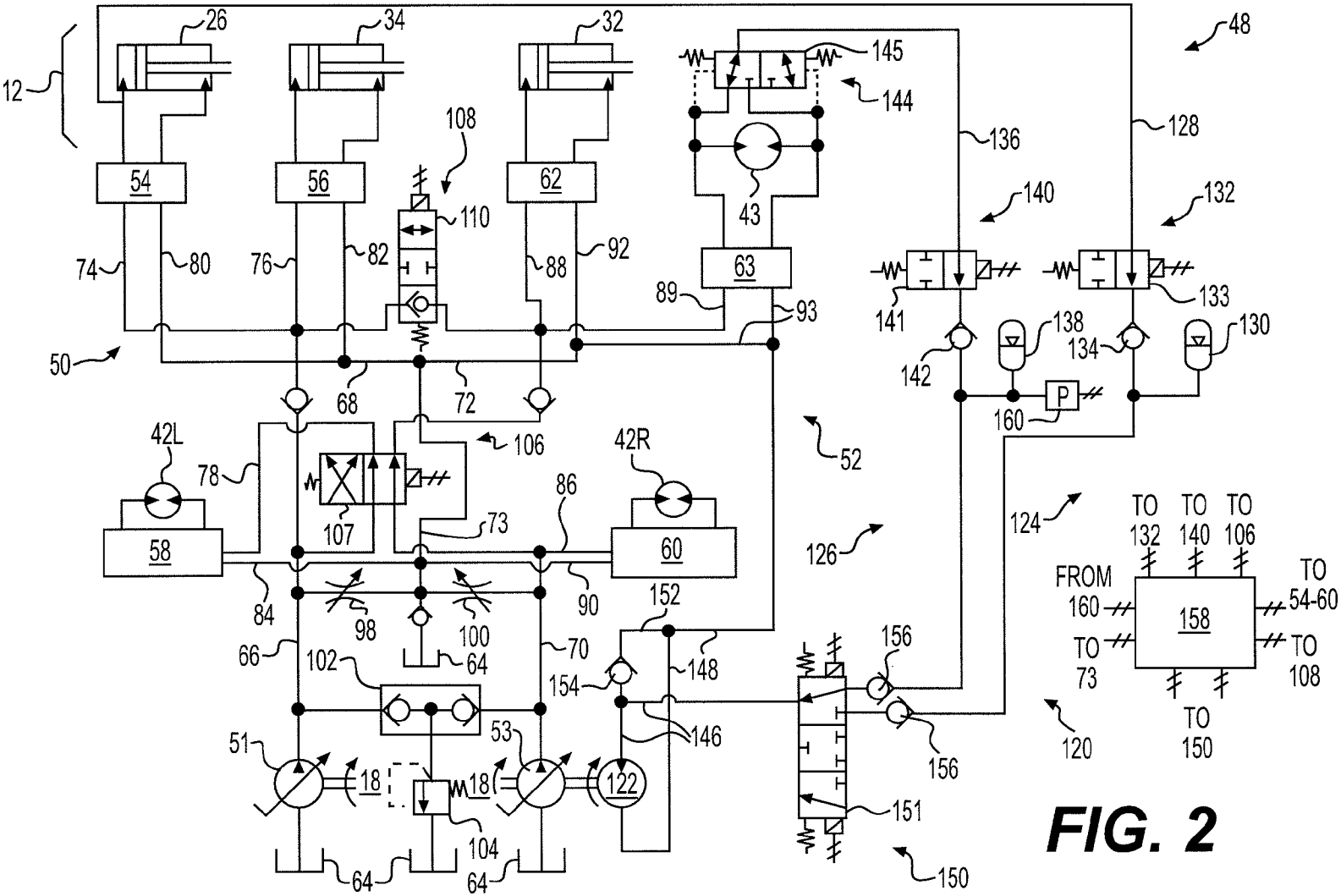
FIG. 2 is a schematic illustration of an exemplary disclosed hydraulic control system that may be used with the machine of FIG. 1.

As illustrated in FIG. 2, machine 10 may include a hydraulic control system 48 having a plurality of fluid components that cooperate to move work tool 14 (referring to FIG. 1) and machine 10. In particular, hydraulic control system 48 may include a first circuit 50 configured to receive a first stream of pressurized fluid from a first source 51, and a second circuit 52 configured to receive a second stream of pressurized fluid from a second source 53. First circuit 50 may include a boom control valve 54, a bucket control valve 56, and a left travel control valve 58 connected in parallel to receive the first stream of pressurized fluid. Second circuit 52 may include a right travel control valve 60, a stick control valve 62, and a swing control valve 63 connected in parallel to receive the second stream of pressurized fluid. It is contemplated that additional control valve mechanisms may be included within first and/or second circuits 50, 52 such as, for example, one or more attachment control valves and other suitable control valve mechanisms.

First and second sources 51, 53 may be configured to draw fluid from one or more tanks 64 and pressurize the fluid to predetermined levels. Specifically, each of first and second sources 51, 53 may embody a pumping mechanism such as, for example, a variable displacement pump (shown in FIG. 1), a fixed displacement pump, or any other source known in the art. First and second sources 51, 53 may each be separately and drivably connected to power source 18 of machine 10 by, for example, a countershaft (not shown), a belt (not shown), an electrical circuit (not shown), or in any other suitable manner. Alternatively, each of first and second sources 51, 53 may be indirectly connected to power source 18 via a torque converter, a reduction gear box, an electrical circuit, or in any other suitable manner. First source 51 may produce the first stream of pressurized fluid independent of the second stream of pressurized fluid produced by second source 53. The outputs of first and second sources 51, 53 may be at different pressure levels and flow rates and determined at least in part by the pressures of the fluid within first and second circuits 50, 52.

Tank 64 may constitute a reservoir configured to hold a supply of fluid. The fluid may include, for example, a dedicated hydraulic oil, an engine lubrication oil, a transmission lubrication oil, or any other fluid known in the art. One or more hydraulic systems within machine 10 may draw fluid from and return fluid to tank 64. It is contemplated that hydraulic control system 48 may be connected to multiple separate fluid tanks or to a single tank, as desired.

Each of boom, bucket, right travel, left travel, stick, and swing control valves 54-63 may regulate the motion of their related fluid actuators. Specifically, boom control valve 54 may have elements movable to control the motion of hydraulic cylinders 26 associated with boom member 22; bucket control valve 56 may have elements movable to control the motion of hydraulic cylinder 34 associated with work tool 14; stick control valve 62 may have elements movable to control the motion of hydraulic cylinder 32 associated with stick member 28; and swing control valve 63 may have elements movable to control the swinging motion of body 38 about vertical axis 41. Likewise, left travel control valve 58 may have valve elements movable to control the motion of left travel motor 42L, while right travel control valve 60 may have elements movable to control the motion of right travel motor 42R.

The control valves of first and second circuits 50, 52 may allow pressurized fluid to flow to and drain from their respective actuators via common passages. Specifically, the control valves of first circuit 50 may be connected to first source 51 by way of a first common supply passage 66, and to tank 64 by way of a first common drain passage 68. The control valves of second circuit 52 may likewise be connected to second source 53 by way of a second common supply passage 70, and to tank 64 by way of a second common drain passage 72. Drain passages 68, 72 may connect to a final drain passage 73 that terminates at tank 64. Boom, bucket, and left travel control valves 54-58 may be connected in parallel to first common supply passage 66 by way of individual fluid passages 74, 76, and 78, respectively, and in parallel to first common and/or final drain passages 68, 73 by way of individual fluid passages 80, 82, and 84, respectively. Similarly, right travel, stick, and swing control valves 60-63 may be connected in parallel to second common supply passage 70 by way of individual fluid passages 86, 88, and 89, respectively, and in parallel to second common and/or final drain passages 72, 73 by way of individual fluid passages 90, 92, and 93, respectively. It is contemplated that check valves (not shown) may be disposed within any or all of fluid passages 74-78, 88, and 89 to provide for a unidirectional supply of pressurized fluid to the respective control valves, if desired.

Because the elements of boom, bucket, left travel, right travel, stick, and swing control valves 54-63 may be similar and function in a related manner, only the operation of swing control valve 63 will be discussed in this disclosure. In one example, swing control valve 63 may include a first chamber supply element (not shown), a first chamber drain element (not shown), a second chamber supply element (not shown), and a second chamber drain element (not shown). The first and second chamber supply elements may be connected in parallel with fluid passage 89 to fill their respective chambers with fluid from second source 53, while the first and second chamber drain elements may be connected in parallel with fluid passage 93 to drain the respective chambers of fluid. To move swing motor 43 in a first direction, first chamber supply element may be shifted to allow the pressurized fluid from second source 53 to fill the first chamber of swing motor 43 with pressurized fluid via fluid passage 89, while the second chamber drain element may be shifted to drain fluid from the second chamber of swing motor 43 to tank 64 via fluid passage 93. To move swing motor 43 in the opposite direction, the second chamber supply element may be shifted to fill the second chamber of swing motor 43 with pressurized fluid, while the first chamber drain element may be shifted to drain fluid from the first chamber of swing motor 43. It is contemplated that both the supply and drain functions of a particular control valve may alternatively be performed by a single element associated with the first chamber and a single element associated with the second chamber, if desired.

The supply and drain elements of a control valve may be solenoid movable against a spring bias in response to a commanded flow rate. In particular, hydraulic cylinders 26, 32, 34 and left travel, right travel, and swing motors 42L, 42R, and 43 may move at a velocity that corresponds to the flow rate of fluid into and out of the first and second chambers. To achieve the operator-desired tool and/or machine velocity, a command based on an assumed or measured pressure may be sent to the solenoids (not shown) of the supply and drain elements that causes them to open an amount corresponding to the necessary flow rate. The command may be in the form of a flow rate command or a valve element position command.

The common supply and drain passages of first and second circuits 50, 52 may be interconnected for makeup and relief functions. In particular, first and second common supply passages 66, 70 may receive makeup fluid from tank 64 by way of first and second bypass elements 98, 100, respectively. As the pressure of the first or second streams drops below a predetermined level, fluid from tank 64 may be allowed to flow into first and second circuits 50, 52 by way of first and second bypass elements 98, 100. It is contemplated that a filter (not shown) may be associated with first and/or second bypass elements 98, 100 to filter the flow of makeup fluid, if desired. First and second common drain passages 68, 72 may relieve fluid from first and second circuits 50, 52 to tank 64 by way of a shuttle valve 102 and a common main relief element 104. As fluid within first or second circuits 50, 52 exceeds a predetermined level, fluid from the circuit having the excessive pressure may drain to tank 64 by way of shuttle valve 102 and common main relief element 104.

A straight travel valve 106 may selectively rearrange left and right travel control valves 58, 60 into a series relationship with each other. In particular, straight travel valve 106 may include a spring-biased, solenoid-activated valve element 107 movable from a neutral position (shown in FIG. 1) toward a straight travel position. When valve element 107 is in the neutral position, left and right travel control valves 58, 60 may be independently supplied with pressurized fluid from first and second sources 51, 53, respectively, to control left and right travel motors 42L, 42R separately. However, when valve element 107 is in the straight travel position, left and right travel control valves 58, 60 may be connected in series to receive pressurized fluid from only first source 51 for dependent movement. When only travel commands are active (e.g., no implement commands are active), valve element 107 may be maintained in the neutral position. If loading of left and right travel motors 42L, 42R is unequal (e.g., left track 40L is on soft ground while right track 40R is on concrete), the separation of first and second sources 51, 53 via straight travel valve 106 may provide for straight travel, even with differing output pressures from first and second sources 51, 53.

Straight travel valve 106 may also be actuated to support implement control during travel of machine 10. For example, if an operator actuates boom control valve 54 during travel of machine 10, valve element 107 of straight travel valve 106 may move to supply left and right travel motors 42L, 42R with pressurized fluid from first source 51 while boom control valve 54 may receive pressurized fluid from second source 53. Valve element 107 may be spring biased toward the straight travel position and solenoid-activated to move toward the neutral position.

When valve element 107 of straight travel valve 106 is moved to the straight travel position, fluid from second source 53 may be substantially simultaneously directed via valve element 107 through both first and second circuits 50, 52 to drive hydraulic cylinders 26, 32, 34. The second stream of pressurized fluid from second source 53 may be directed to hydraulic cylinders 26, 32, 34 of both first and second circuits 50, 52 because all of the first stream of pressurized fluid from first source 51 may be nearly completely consumed by left and right travel motors 42L, 42R during straight travel of machine 10.

A combiner valve 108 may combine the first and second streams of pressurized fluids from first and second common supply passages 66, 70 for high speed movement of one or more fluid actuators. In particular, combiner valve 108 may include a spring-biased, solenoid-activated valve element 110 movable between a neutral position (shown in FIG. 1), a flow-blocking position, and a bidirectional flow-passing position. When in the neutral position, fluid from first circuit 50 may be allowed to flow into second circuit 52 in response to the pressure of first circuit 50 being greater than the pressure within second circuit 52 by a predetermined amount. The predetermined amount may be related to a spring bias and fixed during a manufacturing process. In this manner, when a right travel or stick function requires a rate of fluid flow greater than an output capacity of second source 53 and the pressure within second circuit 52 begins to drop, fluid from first source 51 may be diverted to second circuit 52 by way of valve element 110. When in the bidirectional flow-passing position, the second stream of pressurized fluid may be allowed to flow to first circuit 50 to combine with the first stream of pressurized fluid directed to control valves 54-58. Valve element 110 may be spring-biased toward the neutral position, and solenoid activated to move toward the bidirectional flow-passing position.

Hydraulic control system 48 may also include an energy recovery arrangement 120 in communication with first and second circuits 50, 52 and configured to selectively direct waste fluid having an elevated pressure through a recovery device 122 to extract energy from the fluid. Energy recovery arrangement 120 may include, among other things, a boom recovery circuit 124 and a swing recovery circuit 126. Boom recovery circuit 124 may be configured to direct pressurized waste fluid from a head chamber of hydraulic cylinder 26 through recovery device 122, while swing recovery circuit 126 may be configured to direct pressurized waste fluid from either chamber of swing motor 43 through recovery device 122.

Boom recovery circuit 124 may include a passage 128 extending from the head chamber of hydraulic cylinder 26 to recovery device 122, a boom accumulator 130 in fluid communication with passage 128, and boom charge valve 132 disposed within passage 128 between hydraulic cylinder 26 and boom accumulator 130. A check valve 134 may be disposed within passage 128 between boom accumulator 130 and boom charge valve 132 to help ensure a unidirectional flow of fluid through boom charge valve 132 to boom accumulator 130.

Swing recovery circuit 126 may include a passage 136 extending from swing motor 43 to energy recovery device 122, a swing accumulator 138 in fluid communication with passage 136, and swing charge valve 140 disposed within passage 136 between swing motor 43 and swing accumulator 138. A check valve 142 may be disposed within passage 136 between swing accumulator 138 and swing charge valve 140 to help ensure a unidirectional flow of fluid through swing charge valve 140 to swing accumulator 138. A swing selector valve 144 may fluidly connect a higher-pressure chamber of swing motor 43 to passage 136.

Boom and swing charge valves 132, 140 may each include a solenoid-operated and spring-biased valve element 133, 141, respectively, that is movable to open and flow-passing positions (shown in FIG. 1) from closed or flow-blocking positions when activated. Both of valve elements 133, 141 may be spring-biased toward the flow-blocking positions.

Boom and swing accumulators 130, 138 may each embody a pressure vessel filled with a compressible gas that is configured to store pressurized fluid for future use as a source of power. The compressible gas may include, for example, nitrogen, argon, helium, or another appropriate compressible gas. As fluid in communication with accumulators 130, 138 exceeds a predetermined pressure, the fluid may flow into accumulators 130, 138. Because the gas therein is compressible, it may act like a spring and compress as the fluid flows into accumulators 130, 138. When the pressure of the fluid within passages 128, 136 drops below predetermined pressures of accumulators 130, 138, the compressed gas may expand and urge the fluid from within accumulators 130, 138 to exit. It is contemplated that accumulators 130, 138 may alternatively embody spring-biased types of accumulators, if desired. The predetermined pressures may be in the range of about 150-200 bar.

Swing selector valve 144 may include a bidirectional spring-biased valve element 145 movable between a first position at which a first chamber of swing motor 43 is fluidly connected to passage 136 (shown in FIG. 1), and a second position at which a second opposing chamber of swing motor 43 is fluidly connected to passage 136. Valve element 145 may be biased toward a third position between the first and second positions, and moved to the first and second positions based on a pressure of fluid entering and exiting swing motor 43. That is, when the pressure of fluid in the first side of swing motor 43 exceeds the pressure of fluid in the second side of swing motor 43, valve element 145 may move to the first position to allow the higher pressure fluid into passage 136. Similarly, when the pressure of fluid in the second chamber of swing motor 43 exceeds the pressure of fluid in the first chamber of swing motor 43, valve element 145 may move to the second position to again allow the higher pressure fluid into passage 136.

A supply passage 146 may be configured to receive fluid from passages 128 and 136 and direct the fluid to recovery device 122, while a drain passage 148 may be configured to direct fluid from recovery device 122 to tank 64 via passage 93. A discharge valve 150 may be disposed between passages 128, 136 and supply passage 146. A bypass passage 152 having a check valve 154 disposed therein may selectively connect drain passage 148 to supply passage 146 when a pressure within drain passage 148 exceeds a pressure within supply passage 146, thereby reducing a likelihood of voiding by energy recovery device 122.

Discharge valve 150 may be configured to selectively connect one of passages 128 and 136 to supply passage 146 at a time. In particular, discharge valve 150 may include a dual-solenoid valve element 151 movable between a first position at which passage 128 is fluidly connected to supply passage 146, a second position at which passages 128 and 136 are blocked from supply passage 146, and a third position (shown in FIG. 1) at which passage 136 is fluidly connected to supply passage 146. Valve element 151 may be spring-biased toward the second position and solenoid-activated to move to either of the first and second positions, as desired. A check valve 156 may be disposed within each of passages 128 and 136, just upstream of discharge valve 150, to help ensure a unidirectional flow of fluid through discharge valve 150 into energy recovery device 42.

Energy recovery device 122 may be configured to receive pressurized waste fluid from boom and swing recovery circuits 124, 126 that was previously collected within boom and swing accumulators 130, 138, and be driven by the fluid to generate a mechanical power output. In one embodiment, the mechanical power output generated by energy recovery device 122 may be directed back into hydraulic control system 48, thereby increasing an efficiency of hydraulic control system 48. Energy recovery device 122 may embody, for example, a fixed (shown in FIG. 2) or variable displacement hydraulic motor that is mechanically coupled to power source 18 via second source 53. In this configuration, as the pressurized fluid passes through energy recovery device 122, energy recovery device 122 may be caused to rotate by the pressure of the fluid and thereby drive second source 53 and power source 18. In one embodiment, energy recovery device 122 may be an existing motor normally associated with machine 10, for example a fan motor that forms a portion of an engine cooling system (not shown). By driving second source 53, a load on power source 18 may be reduced and an efficiency of machine 10 increased.

A controller 158 may be in communication with the different components of hydraulic control system 48 to regulate operations of machine 10. For example, controller 158 may be in communication with control valves 54-60, straight travel valve 106, combiner valve 108, boom and swing charge valves 132, 140, and discharge valve 150. Based on various operator input and monitored parameters, as will be described in more detail below, controller 158 may be configured to selectively activate the different valves in a coordinated manner to efficiently carry out operator commands. Controller 158 may include a memory, a secondary storage device, a clock, and one or more processors that cooperate to accomplish a task consistent with the present disclosure. Numerous commercially available microprocessors can be configured to perform the functions of controller 158. It should be appreciated that controller 158 could readily embody a general machine controller capable of controlling numerous other functions of machine 10. Various known circuits may be associated with controller 158, including signal-conditioning circuitry, communication circuitry, and other appropriate circuitry. It should also be appreciated that controller 158 may include one or more of an application-specific integrated circuit (ASIC), a field-programmable gate array (FPGA), a computer system, and a logic circuit configured to allow controller 158 to function in accordance with the present disclosure.

The operational parameters monitored by controller 158, in one embodiment, may include a pressure of fluid within energy recovery arrangement 120. For example, one or more pressure sensors 160 may be strategically located within boom and/or swing recovery circuits 124, 126 that monitor a pressure of the respective circuit and generate a corresponding signal indicative of the monitored pressure directed to controller 158. In the disclosed embodiment of FIG. 2, one pressure sensor 160 is associated with swing recovery circuits 126, and located in close proximity to swing accumulator 138. It is contemplated, however, that a different number of pressure sensors 160 placed in other locations within energy recovery arrangement 120 may alternatively be utilized, if desired. It is further contemplated that other operational parameters such as, for example, temperatures, viscosities, densities, etc. may also or alternatively be monitored and used to control hydraulic control system 48, if desired.

Figure 3:
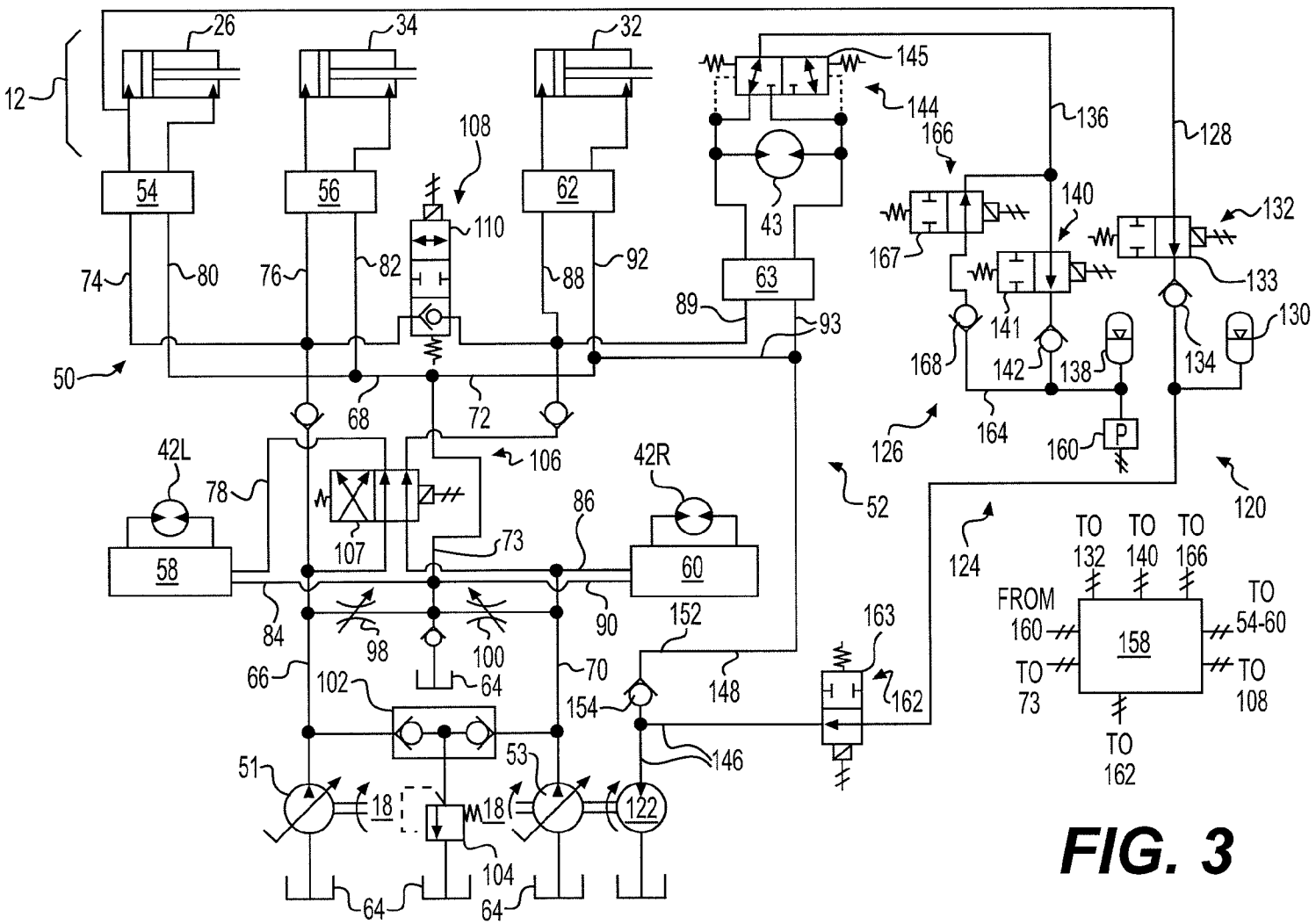
FIG. 3 is a schematic illustration of another exemplary disclosed hydraulic control system that may be used with the machine of FIG. 1.

FIG. 3 illustrates an alternative embodiment of energy recovery arrangement 120. Similar to the embodiment of FIG. 2, energy recovery arrangement 120 of FIG. 3 also has boom and swing recovery circuits 124 and 126, including boom and swing charge valves 132 and 140 and boom and swing accumulators 130 and 138. In contrast to the embodiment of FIG. 2, however, swing recovery circuit 126 of FIG. 3 does not terminate at energy recovery device 122. Instead, swing recovery circuit 126 of FIG. 3 is configured to return energy recovered from waste fluid exiting swing motor 43 back to swing motor 43.

As shown in FIG. 3, discharge valve 150 has been replaced with a boom discharge valve 162 that is configured to regulate accumulator discharging of only boom recovery circuit 124. In addition, a recirculation passage 164 has been added that extends from passage 136 at a location between swing accumulator 138 and swing charge valve 140, to a location between swing charge valve 140 and swing selector valve 144. A recirculation charge valve 166 and a check valve 168 may be disposed within recirculation passage 164. Finally, the output of energy recovery device 122, in the embodiment of FIG. 3, may vent directly into tank 64 instead of by way of passage 93. Passage 93 may still connect to the input of energy recovery device 122 via bypass passage 152 to reduce the likelihood of energy recovery device 122 voiding.

Boom discharge valve 162 may include a solenoid-operated and spring-biased valve element 163 that is movable to an open or flow-passing position (shown in FIG. 1) from a closed or flow-blocking position when activated. Valve element 163 may be spring-biased toward the flow-blocking position.

Recirculation charge valve 166 may be substantially identical to swing charge valve 140, and include a solenoid-operated and spring-biased valve element 167 that is movable to an open or flow-passing position from a closed or flow-blocking position (shown in FIG. 1) when activated. Valve element 167 may be spring-biased toward the flow-blocking position.

INDUSTRIAL APPLICABILITY

The disclosed hydraulic control system may be applicable to any machine that includes multiple fluid actuators where high efficiency is desired. The disclosed hydraulic control system may improve efficiency by selectively recovering energy from the waste fluid of boom and swing actuators. The operation of hydraulic control system 48 will now be explained.

During operation of machine 10 (referring to FIG. 1), a machine operator may manipulate an operator interface device to cause a corresponding movement of work tool 14 and/or machine 10. The actuation position of the operator interface device may be related to an operator-expected or desired velocity of work tool 14 and/or machine 10. The operator interface device may generate a position signal indicative of the operator-expected or desired velocity during manipulation thereof, and send this position signal to controller 158.

Controller 158 may receive the operator interface device position signal and determine desired velocities for each fluid actuator within hydraulic control system 48 and the corresponding flow rate commands for control valves 54-63 and/or sources 51, 53 (referring to FIG. 2). From the interface device position signal, controller 158 may also determine a corresponding position of straight travel valve 106. Controller 158 may then command activation of the appropriate valves to direct pressurized fluid to the corresponding actuators in the manner desired by the operator.

During movement of boom member 22 by hydraulic cylinders 26, it may be possible for the waste fluid exiting hydraulic cylinders 26 to have a pressure significantly greater than a pressure within tank 64. This situation may occur, for example, when boom member 22 is being lowered under the force of gravity, particularly when work tool 14 is heavily loaded. This movement may cause the piston assembly of hydraulic cylinder 26 to force fluid from the head chamber at an elevated pressure. If the fluid discharging from the head chamber of hydraulic cylinders 26 at this time were simply directed to join the lower pressure fluid within tank 64, any energy associated with the discharging fluid would be lost. To improve efficiency of hydraulic control system 48, the energy of the fluid discharged from the head chamber of cylinders 26 may be recovered by directing the fluid through energy recovery device 122.

To extract the fluid energy normally wasted during the lowering of boom member 22, boom charge valve 132 may be commanded by controller 158 to open during the lowering. In this condition, the fluid pushed from the head chamber of hydraulic cylinder 26 by the associated piston assembly under the weight of boom member 22 (and any load in work tool 14), may flow through passage 128 and into accumulator 130. Discharge valve 150 may be closed (i.e., in the neutral position) at this time. Then, at any time during operation of machine 10, when controller 158 determines it to be beneficial, discharge valve 150 may be moved to the first position at which the fluid stored within boom accumulator 130 may flow through passage 146 and into energy recovery device 122. This fluid, because of its elevated pressure, may cause energy recovery device 122 to rotate and drive second source 53 to pressurized fluid, thereby reducing a load on power source 18 and increasing the efficiency of machine 10. Because the fluid energy from boom accumulator 130 may be converted directly into mechanical energy that drives second source 53, as opposed to being reutilized within another hydraulic actuator, the pressure of the accumulated fluid may have little or no effect on its usage. That is, the pressure of the waste fluid from boom accumulator 130 may not have to be a particular pressure before it can be utilized. This ability may help to reduce control complexity or cost of hydraulic control system 48. After imparting rotational mechanical energy to energy recovery device 122, some or all of the draining fluid may be discharged into tank 64 via passages 148 and 93.

It may also be possible, during the swinging movement of body 38 relative to undercarriage 39 by swing motor 43, for the waste fluid exiting swing motor 43 to have a pressure significantly greater than a pressure within tank 64. This situation may occur, for example, toward an end of a swing, when the swinging momentum of machine 10 is significant and functions to drive swing motor 43 as a pump. That is, at the end of a swing of body 38 (and attached implement system 12), after controller 158 has caused pressurized fluid from second source 53 to stop driving swing motor 43, the centrifugal momentum of machine 10 may cause swing motor 43 to continue rotating and pressurize fluid exiting swing motor 43. If the fluid discharged from swing motor 43 at this time were simply directed to join the lower pressure fluid within tank 64, any energy associated with the draining fluid would be lost. To improve efficiency of hydraulic control system 48, the energy of the fluid discharged from swing motor 43 may be recovered by directing the fluid through energy recovery device 122.

To extract the fluid energy normally wasted during the swinging of body 38, swing charge valve 140 may be selectively commanded by controller 158 to open during the later part of a swing. In this condition, the fluid pumped from swing motor 43 by the centrifugal momentum of machine 10, may flow through passage 136 and into accumulator 138. The fluid exiting swing motor 43 may pass through selector valve 144, which may move to the appropriate position according to the rotational direction of swing motor 43 and based on the exiting pressure. Discharge valve 150 may be closed (i.e., in the neutral position) at this time. Then, at any time during operation of machine 10, when controller 158 determines it to be most beneficial, discharge valve 150 may be moved to the second position at which the fluid stored within swing accumulator 138 may flow through passage 146 and into energy recovery device 122. This fluid, because of its elevated pressure, may cause energy recovery device 122 to rotate and drive second source 53 to pressurized fluid, thereby reducing a load on power source 18 and increasing the efficiency of machine 10.

The pressurized fluid pumped from swing motor 43 by the momentum of machine 10 and stored within swing accumulator 138 may alternatively or additionally be used for another purpose. Specifically, as shown in FIG. 3, the pressurized fluid stored within swing accumulator 138 may be selectively directed back to swing motor 43 via recirculation passage 164, when charge valve 166 is commanded to open by controller 158. This returning fluid, because of its elevated pressure, may help to brake the swinging motion of machine 10 and corresponding rotation of swing motor 43. In this situation, the braking applied to swing motor 43 may be based on the pressure of the stored fluid. For this reason, controller 158 may consider the signals generated by pressure sensor 160 during this operation, and adjust the opening of charge valve 140 accordingly.

The disclosed hydraulic system may be simple and inexpensive. Specifically, few control valves may be required to control the discharge of high-pressure fluid collected from the boom and swing actuators of machine 10. The reduced number of control valves may lower a part count and associated cost of hydraulic system 48, while at the same time simplifying the control of hydraulic control system 48. Further, the ability to recover hydraulic energy from both the boom and the swing actuators may increase an efficiency of machine 10.

It will be apparent to those skilled in the art that various modifications and variations can be made to the disclosed hydraulic control system. Other embodiments will be apparent to those skilled in the art from consideration of the specification and practice of the disclosed hydraulic control system. It is intended that the specification and examples be considered as exemplary only, with a true scope being indicated by the following claims and their equivalents.

What is claimed is:

1. A hydraulic control system for a machine, comprising:

a tank;

at least one pump configured to draw fluid from the tank and pressurize the fluid;

a swing motor configured to receive the pressurized fluid and swing a body of the machine relative to an undercarriage;

a tool actuator configured to receive the pressurized fluid and move a tool relative to the body;

an energy recovery device configured to convert hydraulic energy to mechanical energy;

a first accumulator configured to store waste fluid received from the swing motor; and a second accumulator configured to store waste fluid received from the tool actuator, wherein stored waste fluid from at least one of the first and second accumulators is selectively discharged into the energy recovery device.

2. The hydraulic control system of claim 1, wherein both the first and second accumulators are configured to selectively discharge stored waste fluid into the energy recovery device.

3. The hydraulic control system of claim 2, further including a discharge valve disposed between the energy recovery device and the first and second accumulators, the discharge valve having a valve element movable between a first position at which waste fluid from the first accumulator is allowed to pass into the energy recovery device, and a second position at which waste fluid from the second accumulator is allowed to pass into the energy recovery device.

4. The hydraulic control system of claim 3, wherein the discharge valve is a dual-solenoid valve that is spring-biased to a third position at which fluid flow through the discharge valve is inhibited.

5. The hydraulic control system of claim 1, wherein the first accumulator is configured to selectively discharge stored waste fluid received from the swing motor back to the swing motor.

6. The hydraulic control system of claim 1, wherein the energy recovery device is mechanically connected to a power source of the machine.

7. The hydraulic control system of claim 6, wherein the energy recovery device is mechanically connected to the power source by way of the at least one pump.

8. The hydraulic control system of claim 1, further including a swing selector valve configured to selectively pass fluid from a side of the swing motor having a higher pressure.

9. The hydraulic control system of claim 1, further including:

a first charge valve disposed between the swing motor and the first accumulator, the first charge valve being solenoid operated to move from a flow-blocking position to a flow-passing position; and a second charge valve disposed between the tool actuator and the second accumulator, the second charge valve being solenoid operated to move from a flow-blocking position to a flow-passing position.

10. The hydraulic control system of claim 9, further including at least one pressure sensor associated with at least one of the first and second accumulators, wherein movement of at least one of the first and second charge valves is based on a signal from the at least one pressure sensor.

11. The hydraulic control system of claim 1, wherein the at least one pump includes:

a first pump configured to pressurize fluid directed to the swing motor via a first circuit; and a second pump configured to pressurize fluid directed to the tool actuator via a second circuit.

12. The hydraulic control system of claim 1, further including:

a bypass passage fluidly connecting an outlet of the energy storage device to an inlet of the energy storage device; and a check valve disposed within the bypass passage.

13. A method of recovering energy for a machine, comprising:

pressurizing a fluid;

utilizing the pressurized fluid to swing a body of the machine relative to an undercarriage;

utilizing the pressurized fluid to move a tool relative to the body;

storing first pressurized waste fluid used to swing the body; and storing second pressurized waste fluid used to move the tool; and selectively converting hydraulic energy from at least one of the stored first pressurized waste fluid and the stored second pressurized waste fluid to mechanical energy used to pressurize the fluid.

14. The method of claim 13, wherein selectively converting hydraulic energy includes selectively converting hydraulic energy from both the first pressurized waste fluid and the second pressurized waste fluid.

15. The method of claim 14, further including selectively allowing hydraulic energy from only one of the first pressurized waste fluid and the second pressurized waste fluid to be converted to mechanical energy used to pressurize the fluid at a given time.

16. The method of claim 15, further including selectively inhibiting hydraulic energy from either of the first pressurized waste fluid and the second pressurized waste fluid from being converted to mechanical energy used to pressurized the fluid.

17. The method of claim 13, further including discharging a store of the first pressurized waste fluid to brake swinging of the body.

18. The method of claim 13, wherein storing the first pressurized waste fluid includes storing only a higher-pressure one of two flows of fluid associated with swinging of the body.

19. The method of claim 13, further including sensing a stored pressure of at least one of the first pressurized waste fluid and the second pressurized waste fluid, wherein the selectively converting hydraulic energy is based on the stored pressure.

20. A machine, comprising:

an engine an undercarriage drive by the engine;

a body;

a swing motor configured to swing the body relative to the undercarriage;

a tool;

a tool actuator configured to move the tool relative to the body;

a tank;

a first pump driven by the engine to draw fluid from the tank, pressurize the fluid, and direct the pressurized fluid to the swing motor via a first circuit;

a second pump driven by the engine to draw fluid from the tank, pressurize the fluid, and direct the pressurized fluid to the tool;

an energy recovery device connected to one of the first and second pumps and configured to convert hydraulic energy to mechanical energy;

a first accumulator configured to store waste fluid received from the swing motor;

a first charge valve disposed between the swing motor and the first accumulator, the first charge valve being solenoid operated to move from a flow-blocking position to a flow-passing position;

a second accumulator configured to store waste fluid received from the tool actuator;

a second charge valve disposed between the tool actuator and the second accumulator, the second charge valve being solenoid operated to move from a flow-blocking position to a flow-passing position; and at least one pressure sensor associated with at least one of the first and second accumulators, wherein:

stored waste fluid from at least one of the first and second accumulators is selectively discharged into the energy recovery device to drive the engine via the one of the first and second pumps; and movement of at least one of the first and second charge valves is based on a signal from the at least one pressure sensor.

* * * * *